US011781249B2

(12) United States Patent
Sato et al.

(10) Patent No.: US 11,781,249 B2
(45) Date of Patent: Oct. 10, 2023

(54) POLYURETHANE ELASTIC FIBER, YARN PACKAGE OF SAME, AND PRODUCT INCLUDING SAME

(71) Applicant: Asahi Kasei Kabushiki Kaisha, Tokyo (JP)

(72) Inventors: Hitoshi Sato, Tokyo (JP); Taro Yamamoto, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 342 days.

(21) Appl. No.: 16/644,339

(22) PCT Filed: Oct. 15, 2018

(86) PCT No.: PCT/JP2018/038363
§ 371 (c)(1),
(2) Date: Mar. 4, 2020

(87) PCT Pub. No.: WO2019/078170
PCT Pub. Date: Apr. 25, 2019

(65) Prior Publication Data

US 2020/0190702 A1 Jun. 18, 2020

(30) Foreign Application Priority Data

Oct. 18, 2017 (JP) ..... 2017-201691

(51) Int. Cl.
*D01F 6/70* (2006.01)
*D01F 8/04* (2006.01)
*D04H 1/4358* (2012.01)

(52) U.S. Cl.
CPC ..... *D01F 6/70* (2013.01); *D01F 8/04* (2013.01); *D04H 1/4358* (2013.01)

(58) Field of Classification Search
None
See application file for complete search history.

(56) References Cited

U.S. PATENT DOCUMENTS 5,007,193 A 4/1991 Goodley et al.
5,308,697 A 5/1994 Muramoto et al.
(Continued)

FOREIGN PATENT DOCUMENTS

AU 2013358100 A 6/2014
CN 1542182 A 11/2004
(Continued)

OTHER PUBLICATIONS

Machine translation of JP 2015206150 (Year: 2015).*
(Continued)

*Primary Examiner* — Shawn McKinnon
(74) *Attorney, Agent, or Firm* — Morgan, Lewis & Bockius LLP

(57) ABSTRACT

Provided is a polyurethane elastic fiber wherein surface treating agents do not bleed even after lengthy storage, thereby preventing contamination of packing material, and which exhibits stable friction performance independent of storage duration, making the fiber suitable for a stable gathered member with low occurrence of core slip-back. This polyurethane elastic fiber is a multifilament polyurethane elastic fiber and is characterized by having, in the multifilament cross section, a void part demarcated by the constituent individual filaments being in contact with one another and by having a cross-sectional void part area ratio of 15% to 60% as calculated according to the formula (cross-sectional void part area ratio [%])=100×(area of the void part)/(total cross-sectional area), where the total cross-sectional area is the sum of the area of the void part and the cross-sectional areas of all individual filaments that constitute the multifilament.

12 Claims, 4 Drawing Sheets

(56) References Cited

U.S. PATENT DOCUMENTS

| | | | | |
|---|---|---|---|---|
| 5,723,080 | A | 3/1998 | Bruner et al. | |
| 6,492,021 | B1 | 12/2002 | Reinehr et al. | |
| 6,508,897 | B1 | 1/2003 | Yamaguchi et al. | |
| 2001/0039790 | A1 | 11/2001 | Umezawa et al. | |
| 2010/0222761 | A1* | 9/2010 | Westwood | D04H 3/14 428/196 |
| 2013/0298519 | A1* | 11/2013 | Smith | D01F 8/16 57/224 |

FOREIGN PATENT DOCUMENTS

| | | | |
|---|---|---|---|
| CN | 101748541 | A | 6/2010 |
| JP | H04-211316 | A | 8/1992 |
| JP | 2628502 | B2 | 4/1997 |
| JP | H10-310979 | A | 11/1998 |
| JP | 2000-054257 | A | 2/2000 |
| JP | 2002-519528 | A | 7/2002 |
| JP | 2012-207332 | A | 10/2012 |
| JP | 2015-206150 | A | 11/2015 |
| JP | 2015-206151 | A | 11/2015 |
| JP | 2015206150 | * | 11/2015 |
| JP | 2016-035122 | A | 3/2016 |
| JP | 2016-211131 | A | 12/2016 |
| KR | 10-2004-0033331 | A | 4/2004 |
| TW | 476826 | B | 10/2000 |
| WO | 2014/092088 | A1 | 6/2014 |
| WO | 2015/125753 | A1 | 8/2015 |

OTHER PUBLICATIONS

Kobunshi, "Spandex-Polyurethane Elastomer Fiber-," 12: 20-26 (1963) (see partial English translation).

International Search Report issued in corresponding International Patent Application No. PCT/JP2018/038363 dated Jan. 8, 2019.

International Preliminary Report on Patentability and Written Opinion issued in corresponding International Patent Application No. PCT/JP2018/038363 dated Apr. 21, 2020.

Supplementary European Search Report in counterpart European Patent Application No. 18869355.0 dated Oct. 27, 2020.

Rinke, "Elastomeric Fibers Based on Polyurethanes," Angewandte Chemie International Edition, 1 (8): 419-424 (1962).

Dyeing and Finishing (Monthly), 28 (11): 30-31 (Nov. 2002)(see partial English translation).

Hatta et al., "Effect of Yarn Cross Section on Air Drag for Spandex Yarn," Journal of the Textile Machinery Society of Japan, 50 (8): 216-223 (1997).

* cited by examiner

POLYURETHANE ELASTIC FIBER, YARN PACKAGE OF SAME, AND PRODUCT INCLUDING SAME

FIELD

The present invention relates to a polyurethane elastic fiber, a yarn package thereof, and a product including the same.

BACKGROUND

Polyurethane elastic fibers have elastic characteristics with excellent elongation. However, polyurethane polymers are materials with flexibility and adhesiveness, such that in the process of manufacturing products which use the fibers thereof, thread breakage and production variation occur due to friction resistance with the guides and rollers, and when unpacking from a yarn package. These problems are extremely apparent particularly when using after long-term storage.

Applying a treatment agent such as silicone oil to the threads to solve these problems is a known method.

In PTL 1 below, applying a treatment agent consisting of a specific lubricant and an unpacking improver to polyurethane elastic fibers is reported as a method to solve the daily worsening of unpacking. Additionally, in PTL 2, use of an elastic fiber treatment agent consisting of a specific quantitative mixture of specific components such as dialkyl sulfosuccinate is proposed to improve unpacking after high-temperature storage.

However, in these methods of applying a specific surface treating agent to the surface of polyurethane elastic fiber, the friction characteristics of the fiber surface improve temporarily, but there is the problem that because the treatment agent of the fiber surface moves during storage, the packing materials become dirtied and the friction fluctuates over time while in storage. Additionally, if the polyurethane elastic fibers manufactured according to the method of either PTL 1 or PTL 2 are interposed between non-woven cloths to make a gathered member, there is the problem that since the amount of treatment agent adhering to the surface of the polyurethane elastic fiber is unstable, sufficient adhesion cannot be obtained and the fibers can slip-back to the product.

In PTL 3 below, manufacturing of a diaper-use gathered member having high adhesiveness by using flat spandex from wet spinning is proposed. However, in addition to the conventional problem that wet spinning has low productivity, while the adhesion surface area is improved by making the multifilament cross-section flat, similarly to PTL 1 and PTL 2, the adhesion state of the treatment agent on the surface is unstable, and a gathered member with sufficiently low occurrence of core slip-back cannot be obtained.

Thus, in order to obtain a polyurethane elastic fiber with improved smoothness and friction characteristics and a gathered member with a low occurrence of core slip-back, a method of applying various surface treating agents on the fiber surface, and a method of making the fiber cross-section flat have been examined, but a sufficient solution to the problems of dirtying of the packing materials and fluctuations in friction characteristics due to the surface treating agent while in long-term storage, such as storage in a product warehouse, and a sufficient solution to the problem of polyurethane elastic fibers slipping into the gathered member have not be achieved.

CITATION LIST

Patent Literature

[PTL 1] Japanese Unexamined Patent Publication (Kokai) No. 2016-211131

[PTL 2] WO2015/125753

[PTL 3] Japanese Unexamined PCT Publication (Kohyo) No. 2002-519528

SUMMARY

Technical Problem

In view of the problems with conventional technology as described above, the object to be achieved by the present invention is to provide a polyurethane elastic fiber wherein surface treating agents do not bleed even after lengthy storage, thereby preventing dirtying of packing material, and which exhibits stable friction performance independent of storage duration, making the fiber suitable for a stable gathered member with low occurrence of core slip-back, and a stable gathered member with low occurrence of core slip-back of polyurethane elastic fibers.

Solution to Problem

The present inventors have discovered, through keen observation and repeated experiments to achieve the above object, that the above object could be achieved by setting the cross-sectional void surface area ratio of the multifilament constituting the polyurethane elastic fiber to not less than a specific value, and have thereby completed the present invention.

Specifically, the present invention is as follows.

[1] A polyurethane elastic fiber comprising a multifilament, characterized by having, in a cross-section of the multifilament, a void part demarcated by the constituent individual filaments being in contact with one another, and by having a cross-sectional void area ratio of 15% to 60% as calculated according to the formula:

$$\text{cross-sectional void area ratio (\%)} = (\text{area of the void part}/\text{total cross-sectional area}) \times 100,$$

where the total cross-sectional area is the sum of the area of the void part and the cross-sectional areas of all the individual filaments which constitute the multifilament.

[2] The polyurethane elastic fiber of [1], wherein the fineness of the multifilament is not less than 150 dt and not more than 1300 dt.

[3] The polyurethane elastic fiber of [1] or [2], wherein the fineness of the multifilament is not less than 150 dt and not more than 900 dt. [4] The polyurethane elastic fiber of any one of [1] to [3], wherein the number of individual filaments constituting the multifilament is not less than 14 and not more than 140.

[5] The polyurethane elastic fiber of any one of [1] to [4], wherein in the multifilament cross-section, there exists at least one void part greater than an individual filament having a diameter equal to the average individual filament diameter calculated using all of the individual filaments constituting the multifilament.

[6] The polyurethane elastic fiber of any one of [1] to [5], wherein an individual filament looseness occurrence rate is not more than 20% when an operation of extending a 40 mm-long multifilament to a length of 240 mm and then returning the multifilament to 40 mm again with a De Mattie tester is repeated 5000 times at a speed of 200 rpm.

[7] The polyurethane elastic fiber of any one of [1] to [6], wherein the individual filament looseness occurrence rate is not more than 13%.

[8] The polyurethane elastic fiber of any one of [1] to [7], wherein the content of a long-chain aliphatic metal salt having 10 to 20 carbon atoms is 0 to 0.2 mass % relative to the weight of polyurethane elastic fiber.

[9] A yarn package comprising the polyurethane elastic fiber of any one of [1] to [8].

[10] The yarn package of [9], wherein the running stress in draft 3.0 is not less than 0.075 g/dt and not more than 0.130 g/dt.

[11] A fabric comprising the polyurethane elastic fiber of any one of [1] to [8].

[12] A gathered member comprising the polyurethane elastic fiber of any one of claims 1 to 8 interposed between non-woven cloths.

[13] A gathered member comprising a polyurethane elastic fiber characterized by having, in the cross-section of polyurethane elastic fiber consisting of a multifilament which is contained in the gathered member, a void part demarcated by the constituent individual filaments being in contact with one another, and by having a cross-sectional void area ratio of 15% to 60% as calculated according to the formula:

$$\text{cross-sectional void area ratio (\%)} = (\text{area of the void part/total cross-sectional area}) \times 100,$$

where the total cross-sectional area is the sum of the area of the void part and the cross-sectional areas of all individual filaments that constitute the multifilament.

Advantageous Effects of Invention

If the polyurethane elastic fibers of the present invention are used, even in the case of applying a surface treating agent, the surface treating agent does not move readily during long-term storage, and dirtying of the packing materials and daily fluctuations of the friction characteristics can be suppressed, such that even when using at high speed such as with knitting, the frequency of problems such as thread breakage can be reduced and productivity can be increased. Additionally, since the amount of surface treating agent adhering to the polyurethane elastic fiber even when in a gathered member is stable, a gathered member with uneven adhesion of the surface treating agent (i.e., few adhesion spots) and a low occurrence of core slip-back of the polyurethane elastic fiber due to bleeding can be provided.

DESCRIPTION OF EMBODIMENTS

Figure 1:
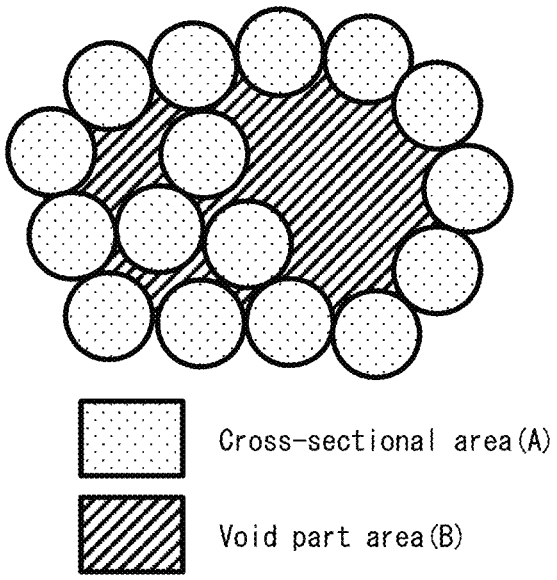
FIG. 1 is a schematic diagram of the multifilament cross-section for explaining the cross-section part and the void part at the time of calculating the cross-sectional void surface area ratio.

The embodiments for carrying out the present invention (hereinafter, "the present embodiment") will be explained in detail below. The present invention is not limited to the following embodiments, and can be carried out in various forms within the scope indicated thereby.

The present embodiment is a polyurethane elastic fiber comprising a multifilament, characterized by having, in a cross-section of the multifilament, a void part demarcated by the constituent individual filaments being in contact with one another, and by having a cross-sectional void area ratio of 15% to 60% as calculated according to the formula:

$$\text{cross-sectional void area ratio (\%)} = (\text{area of the void part/total cross-sectional area}) \times 100,$$

where the total cross-sectional area is the sum of the area of the void part and the cross-sectional areas of all the individual filaments which constitute the multifilament.

The cross-section void area ratio is preferably not less than 18%, or more preferably not less than 20%. The higher the cross-sectional void part area ratio, the better. However, if the cross-sectional void part area ratio is over 60%, there is a risk that the multifilament can loosen easily and breakage can occur, so a ratio of not more than 60% is preferable, or more preferably not more than 50%.

The polyurethane elastic fiber of the present embodiment is a fiber obtained from spinning a polyurethane polymer.

Regarding the method of manufacturing the polymer, which is a raw material for the polyurethane elastic fiber of the present embodiment, a known technique for a polyurethane reaction can be used. A polyurethane polymer can be obtained by reacting a high molecular weight polyol, for example, polyalkylene ether glycol, with an excess of a diisocyanate to synthesize a urethane prepolymer having an isocyanate on an end, and then performing a chain extension reaction of the urethane prepolymer with an active hydrogen-containing compound, such as a bifunctional amine.

As a polymer substrate preferable for the polyurethane elastic fiber of the present embodiment,
there is the polyurethane-urea polymer obtained by reacting a polyalkylene ether glycol having a number average molecular weight of 500 to 5000 with excess equivalent of a diisocyanate to synthesize a prepolymer having an isocyanate group on an end, and then reacting the prepolymer with a bifunctional amine and a monofunctional amine.

The high molecular weight polyol can be any type of diol substantially consisting of linear homo- or co-polymers, for example, polyester diol, polyether diol, polyester amide diol, polyacryl diol, polythioester diol, polythioether diol, polycarbonate diol, a mixture thereof, or a copolymer thereof, and is preferably a polyalkylene ether glycol, for example, polyoxyethylene glycol, polyoxypropylene glycol, polytetramethylene ether glycol, polyoxypentamethylene glycol, a polyether glycol copolymer consisting of a tetramethylene group and a 2,2-dimethylpropylene group, and a polyether glycol copolymer consisting of a tetramethylene group and a 3-methyltetramethylene group, or a mixture thereof. In particular, from the perspective of demonstrating excellent elastic functionality, the high molecular weight polyol is preferably polytetramethylene ether glycol, or a copolymer polyether glycol consisting of a tetramethylene group and a 2,2-dimethylpropylene group.

The diisocyanate can be an aliphatic, alicyclic, or aromatic diisocyanate. For example, it can be 4,4'-diphenylmethane diisocyanate, 2,4'-diphenylmethane diisocyanate, 2,4- or 2,6-tolylene diisocyanate, m- or p-xylylene diisocyanate, α,α,α',α'-tetra methyl-xylylene diisocyanate, 4,4'-diphenyl ether diisocyanate, 4,4'-dicyclohexyl diisocyanate, 1,3- or 1,4-cyclohexylene diisocyanate, 3-(α-isocyanatoethyl)phenyl isocyanate, 1,6-hexamethylene diisocyanate, trimethylene diisocyanate, tetramethylene diisocyanate, isophorone diisocyanate, a mixture thereof, or a copolymer thereof. In particular, 4,4'-diphenylmethane diisocyanate is preferable.

The active hydrogen-containing compound, i.e., the chain extending agent having a multifunctional active hydrogen atom, can be, for example, a low molecular diol such as hydrazine, polyhydrazine, ethylene glycol, 1,2-propylene glycol, 1,3-propylene glycol, 1,3-butanediol, 1,4-butanediol, 1,5-pentanediol, 1,6-hexanediol, 2,2-dimethyl-1,3-propanediol, diethylene glycol, dipropylene glycol, 1,4-cyclohexanedimethanol, phenyldiethanolamine, or a bifunctional amine such as ethylenediamine, 1,2-propylenediamine, 1,3-propylenediamine, 2-methyl-1,5-pentanediamine, triethylenediamine, m-xylylenediamine, piperazine, o-, m- or p-phenylenediamine, 1,3-diaminocyclohexane, 1,4-diaminocyclohexane, 1,6-hexamethylenediamine, or N, N'-(methylenedi-4,1-phenylene)bis[2-(ethylamino)-urea].

The above can be used independently or in combination. Bifunctional amines are more preferable than low molecular weight diols. Ethylene diamine alone or a mixture of ethylene diamine with 5 to 40 mol % of at least one selected from the group of 1,2-propylene diamine, 1,3-diaminocyclohexane, and 2-methyl-1,5-pentadiamine is preferable. Ethylene diamine alone is more preferable.

The end terminator having a monofunctional active hydrogen atom can be, for example, a monoalcohol such as methanol, ethanol, 2-propanol, 2-methyl-2-propanol, 1-butanol, 2-ethyl-1-hexanol, or 3-methyl-1-butanol, a monoalkylamine such as isopropylamine, n-butylamine, t-butylamine, or 2-ethylhexylamine, or a dialkylamine such as diethylamine, dimethylamine, di-n-butylamine, di-t-butylamine, diisobutylamine, di-2-ethylhexylamine, or diisopropylamine. These can be used individually or in combination as a mixture. A monoalkylamine or dialkylamine which is a monofunctional amine is preferable.

Regarding the operation of the polyurethane reaction, during the urethane prepolymer synthesis, or during the reaction of the urethane prepolymer and an active hydrogen-containing compound, an amide polar solvent such as dimethyl formamide, dimethyl sulfoxide, or dimethylacetamide can be used, and preferably, dimethylacetamide is used.

The polyurethane polymer composition can include titanium oxide, or any type of stabilizer or pigment. For example, photostabilizers, hindered phenols, benzotriazoles, benzophenones, phosphorus-based and various hindered amine-based antioxidants, metal soaps (long chain fatty acid metal salts) represented by magnesium stearate, inorganic materials such as iron oxide, zinc oxide, cerium oxide, and magnesium oxide, antibacterial agents and deodorant containing carbon black, various pigments, silver, zinc and their compounds, antistatic agents, nitric oxide scavengers, thermal oxidation stabilizers, and light stabilizers can be added in for joint use.

The polyurethane polymer obtained in this way can be formed into fibers using a known method of dry spinning, melt spinning, or wet spinning to obtain a polyurethane elastic fiber. Additionally, the polyurethane polymer can be mixed, before the spinning step, with a polyurethane polymer polymerized using a different raw material, and spun.

The polyurethane elastic fiber of the present embodiment can contain a surface treating agent for reducing resistance at the time of unpacking and friction at the time of use. The surface treating agent can be kneaded into the spinning dope in advance or can be applied using a known method such as roll oiling, guiding oiling, or spray oiling before taking-up on the paper tube during spinning. Additionally, without applying a surface treating agent, the fiber can be rewound after taking-up and the surface treating agent applied during the step of making a different yarn package.

The composition of the surface treating agent is not particularly limited, but can contain a combination of known surface treating agents, such as polydimethylsiloxane, polyester-modified silicone, polyether-modified silicone, amino-modified silicone, mineral oil, mineral fine particles such as silica, colloidal alumina, or talc, a higher fatty acid metal salt powder such as magnesium stearate, or calcium stearate, or a wax which is solid at room temperature such as higher aliphatic carboxylic acid, higher aliphatic alcohol, paraffin, or polyethylene.

Considering the friction characteristics during use of the product, the use of a surface treating agent having not less than 20% of polydimethylsiloxane is preferable, but from the perspective of preventing bleeding or movement of the treatment agent over time, a polydimethysiloxane content in the treatment agent of less than 90% is preferable, and less than 80% is more preferable.

The applied amount of surface treating agent relative to the weight of the polyurethane elastic fiber of the present Embodiment is preferably not less than 0.2% and less than 5.0%. When the applied amount is less than 0.2%, the friction resistance of the polyurethane elastic fiber increases, such that problems such as thread breakage during use occur more readily. Conversely, if the applied amount is greater than 5%, dirtying of the package materials and fluctuation in friction characteristics due to bleeding of the surface treating agent from the polyurethane elastic fiber during long-term storage are likely to occur. From the perspective of friction characteristics and bleeding of the surface treating agent, the applied amount of the surface treating agent is more preferably not less than 0.5% to not more than 4%.

The method of spinning the polyurethane elastic fiber of the present invention is not particularly limited, but is preferably performed by dissolving the polyurethane polymer in an amide polar solvent and dry spinning the obtained polyurethane spinning dope. Compared to melt spinning and wet spinning, dry spinning can form the strongest physical crosslinking due to hydrogen bonding between hard segments. Additionally, dry spinning is preferable from the perspective that polyurethane elastic fibers with a high cross-sectional void area ratio and individual filaments that do not loosen readily can be obtained. With melt spinning, it is difficult to manufacture a polyurethane elastic fiber of a multifilament where the individual filaments are sufficiently bundled and do not loosen readily. With wet spinning, the manufacturability is low, and it is difficult to manufacture a multifilament with a high cross-sectional void area ratio.

The multifilament with a high cross-sectional void area ratio which is the polyurethane elastic fiber of the present embodiment can be obtained using a combination of methods, such as a method of spreading the nozzle hole distance (hole-to-hole pitch) from which the spinning dope is emitted during spinning, a method of adjusting the air pressure of the air false-twist texturing machine at the time of spinning, and a method of adjusting the speed ratio of the godet roller and the take-up device at the time of spinning and taking-up. Additionally, if adding a specific additive to the spinning dope or using dry spinning, the cross-sectional void area ratio can be adjusted via the air supply method (air flow direction and temperature) at the time of spinning. Additionally, it is easier to obtain a multifilament with a high cross-sectional void area ratio without a step of passing through a press roller which crushes the multifilament on the path of the fiber during spinning. However, the manufacturing method is not limited hereto as long as the polyurethane elastic fiber has a cross-sectional void area ratio of not less than 15% and not more than 60%.

The manufacturing method for obtaining the polyurethane elastic fiber with a high cross-sectional void area ratio of the present embodiment is preferably dry spinning from the perspective of filaments that do not loosen readily and have a high cross-sectional void area ratio. Additionally, the hole-to-hole pitch is preferably wide, and preferably not less than 12 mm and less than 30 mm. If the hole-to-hole pitch is less than 12 mm, it is difficult to obtain filaments with a high cross-sectional void area ratio, and if the hole-to-hole pitch is over 30 mm, it is difficult to aggregate the multifilament, and the filaments are more likely to loosen. For the array of nozzles over the spinning holes, a circular array is preferable from the perspective of obtaining even filament characteristics. The air false-twist texturing at the time of spinning is preferably suitably weak. If the operating pressure is not less than 0.1 MPa and less than 30 MPa when using an air false-twist texturing machine, it is easy to obtain filaments that do not loosen readily and for which the cross-sectional void area ratio is high. If the operating pressure is less than 0.1 MPa, the multifilament does not bundle sufficiently, and filaments tend to loosen easily, whereas if the operating pressure is not less than 0.30 MPa, it is difficult to obtain threads with a high cross-sectional void area ratio. More preferably, the range of the operating pressure is not less than 0.1 MPa and less than 0.25 MPa. The speed ratio of the godet roller and the take-up device should be low, and is preferably not less than 1.03 and less than 1.17. If the speed ratio is less than 1.03, the threads warp during spinning and break readily, such that production of threads is difficult. If the speed ratio is not less than 1.17, it is difficult to obtain a multifilament with a high void area. More preferably, the speed ratio of the godet roller and take-up device is not less than 1.03 and less than 1.15, or most preferably, not less than 1.05 and less than 1.13. In order to obtain a multifilament with individual filaments that do not loosen readily while maintaining a high cross-sectional void area ratio, the content of a long-chain fatty acid metal salt having 10 to 20 carbon atoms (for example, a fatty acid metal such as magnesium stearate) is preferably not more than 0.2 wt %. The means of including a long-chain fatty acid metal salt can either be a method of directly mixing in with the spinning dope, or a method of mixing with a surface treating agent and applying to the thread surface during spinning. If the amount of a long-chain fatty acid metal salt such as magnesium stearate is not more than 0.2 wt %, the lubricating effect of the long-chain fatty acid metal salt is good, such that the surface adhesion at contact points of individual units is sufficient, and loosening of filaments occurs less readily. More preferably, the content of fatty acid metal salt is not more than 0.1 wt %.

The long-chain fatty acid metal salt having 10 to 20 carbon atoms can be a magnesium salt or calcium salt of a long-chain fatty acid consisting of stearic acid, 12-hydroxystearic acid, palmitic acid, oleic acid, or lauric acid, and is preferably a magnesium salt. In particular, the long-chain fatty acid metal salt is preferably magnesium stearate, but it can be used individually or in combination with a magnesium salt of a long-chain fatty acid having 10 to 20 carbons.

The polyurethane elastic fiber of the present embodiment obtained from spinning preferably has a fineness of not less than 150 dt and not more than 1300 dt. If the fineness is too low, thread breakage occurs more readily during the manufacturing process, and it is difficult to obtain the polyurethane elastic fiber with a high cross-sectional void area ratio of the present invention. Conversely, if the fineness is too high, the individual filaments of the multifilament do not aggregate as readily, so the problem of loosening occurs more readily. More preferably, the fineness is not less than 150 dt and not more than 900 dt, or even more preferably, not less than 300 dt and not more than 900 dt, or most preferably, not less than 300 dt and not more than 800 dt.

The multifilament constituting the polyurethane elastic fiber of the present embodiment preferably contains not less than 14 and not more than 140 individual filaments. If there are too few filaments, the tensile force during spinning is low, thread breakage occurs more readily, and it is difficult to obtain a thread with a high cross-sectional void area ratio. From the perspective of easily obtaining a multifilament with a high cross-sectional void area ratio, the number of individual filaments is preferably not less than 20, or more preferably not less than 25. Conversely, if there are too many filaments, the individual filaments of the multifilament aggregate less readily, and the problem of loosening occurs more readily. From the perspective of preventing loosening of individual filaments, the number of individual filaments is preferably not more than 120, more preferably not more than 100, even more preferably not more than 90, or most preferably not more than 80.

The fineness of the individual filaments of the multifilament constituting the polyurethane elastic fiber of the present embodiment is, from the perspective of spinnability and the physical characteristics of the product, preferably 8 to 14 dt (decitex, dtex), or more preferably 8 to 11 dt. If the fineness of the individual filaments is less than 8 dt, thread breakage during spinning occurs more readily, whereas if the fineness is more than 14 dt, it is difficult to obtain threads with sufficient stress.

The cross-sectional shape of an individual filament can be either a perfect circle or an irregular shape such as an oval, but from the perspective of looseness of individual filaments during use of the product, a shape close to a perfect circle is preferable.

In the cross-section of the multifilament of the polyurethane elastic fiber of the present embodiment, there is preferably at least one void part larger than the thickness of an individual filament having the same diameter as the average individual filament diameter calculated based on all individual filaments constituting the multifilament, more preferably at least two such voids, or most preferably, at least three such voids. The polyurethane elastic fiber of the present embodiment having such a void part is particularly preferable because it can prevent bleeding of surface treating agents. The specific method of finding the number of void parts will be described hereinafter.

The polyurethane elastic fiber of the present embodiment has an individual filament looseness occurrence rate found by the method described hereinafter of not more than 20%, or more preferably not more than 13%. If the individual filament looseness occurrence rate is not more than 20%, the effect of suppressing bleeding of the surface treating agent is enhanced. The principle behind this is not exactly clear, but it is considered to be that the cross-sectional void part demarcated by the binding forces at contact points between individual filaments at the level in which the looseness occurrence rate is not more than 20% has a higher retention capacity for the surface treating agent than the cross-sectional void part of a multifilament in which the looseness occurrence rate is more than 20%, and therefore the multifilament with the lower looseness occurrence rate is more effective at suppressing bleeding.

The polyurethane elastic fiber of the present embodiment can be made into a yarn package by taking-up around any paper tube or plastic tube. The surface of the paper tube or plastic tube can be coated in parchment paper or a resin such as PE, and grooves for tail threads can be carved into the paper tube or plastic tube.

The yarn package of the present embodiment has a running stress of preferably not less than 0.075 g/dt and not more than 0.130 g/dt, as measured by draft 3.0 according to a method described hereinafter. By taking-up such that the running stress is within this range, threads with a high cross-sectional void area ratio are more easily obtained, and fluctuations of cross-sectional void area ratio during long-term storage after taking-up on a paper tube are small, such that a product with an extremely stable cross-sectional void area ratio can be obtained. More preferably, the lower limit is not less than 0.080 g/dt and the upper limit is not more than 0.125 g/dt.

The polyurethane elastic fiber of the present embodiment or the polyurethane elastic fiber supplied from the yarn package can be made into an elastic gathered member for use in sanitary materials used in diapers and sanitary items by interposing the fiber between any non-woven cloths or films. The polyurethane elastic fiber of the present embodiment or the polyurethane elastic fiber supplied from the yarn package has a stable amount of treatment agent on the thread surface since bleeding of the treatment agent is suppressed, and therefore, it has a stable adhesion to non-woven cloths, films, and adhesives, and a stable product with a low occurrence of core slip-back can be obtained. The non-woven cloths used to create the gathered member can be made using a known method of manufacture using a known material, such as polypropylene, polyethylene, polyethylene terephthalate, or polylactic acid. The non-woven cloth can be formed of a plurality of layers, and can be embossed.

As the method for adhering the polyurethane elastic fiber to the film or non-woven cloth, a known method such as using a hot melt adhesive, thermocompression rolling or ultrasonic bonding can be used, and since the amount of treatment agent on the thread surface is stable for the polyurethane elastic fiber of the present embodiment, any of the methods can obtain high adhesion.

The cross-sectional void area ratio of the polyurethane elastic fiber taken from the gathered member of the present embodiment according to a method described hereinafter is preferably not less than 15% and not more than 60%. When the cross-sectional void area ratio of the polyurethane elastic fiber taken from the gathered member is in this range, the amount of a surface treating agent adhered to the surface of the thread, even when in the gathered member, is stable due to the bleeding-suppressing effect of the cross-sectional void part, such that the adhesive force with polyurethane elastic fibers and other materials is strong, and core slip-back occurs less readily.

The polyurethane elastic fiber of the present embodiment can be co-weaved with natural fibers such as cotton, silk, or wool, polyamide fibers such as nylon 6 or nylon 66, polyester fibers such as polyethylene terephthalate, polytrimethylene terephthalate, or polytetramethylene terephthalate, cation dyeable polyester fiber, copper ammonia regenerated rayon, viscose rayon, or acetate rayon, or can be made into processed thread using these fibers via covering, entangling, and twisting and then weaved to obtain a high-quality fabric with no spots. In particular, fabric using polyurethane elastic fiber is produced in large amounts and is supplied as bear thread, and thus is suitable for warp-knitted items in which the quality of the raw thread has a large influence. Warp-knitted fabrics include power net, satin net, raschel lace, two-way tricot, and by using the polyurethane elastic fiber of the present embodiment, a high-quality fabric with few seams in the longitudinal direction can be obtained.

The fabric in which the polyurethane elastic fiber of the present embodiment is used can be used for swimwear, girdles, brassieres, intimate products, underwear and all other types of stretch foundation, tights, stockings, waistbands, body suits, spats, stretch sportswear, stretch outerwear, medical wear, or stretch lining.

The polyurethane elastic fiber of the present embodiment, the yarn package thereof, and the gathered member including the polyurethane elastic fiber can be suitably used in sanitary materials such as sanitary items or paper diapers, have good smoothness, and have little fluctuation in friction characteristics such that high productivity and stable products can be obtained. Additionally, the amount of a treatment agent on the surface of the polyurethane elastic fiber in the gathered member is stable such that the adhesive force with other materials is strong, whereby a gathered member with low occurrence of core slip-back of the polyurethane elastic fiber or diapers and sanitary items containing the gathered member can be obtained.

EXAMPLES

The present invention will be specifically described by way of the Examples. However, the present invention is not limited thereto. Furthermore, the measurement methods and evaluation methods used for the Examples and Comparative Examples below are as follows.

(1) Measurement of Cross-Sectional Void Area Ratio

The cross-section of one multifilament was photographed by SEM, and from the cross-section photograph, the area (A) of the cross-sectional part of all individual filaments constituting the multifilament in the SEM photograph, and the area (B) of the void part demarcated by the mutual contacting of individual filaments constituting the multifilament were calculated using the following formula:

$$\text{Cross-sectional void area ratio (\%)} = (\text{area of the void part/total cross-sectional area}) \times 100$$

The total cross-sectional area is found by summing (A+B) the area (A) of the cross-sectional part and the area (B) of void part.

The multifilament thread for taking the SEM photograph of the cross-section was pinched as 1 strand of the multifilament using 2 sheets of cardboard with double-sided tape adhered thereto, the pinched multifilament was cut off very close to the edge of cardboard using a razor blade, the sample was set on the SEM stage so that the cross-section could be observed from the front, and then the sample was observed. According to the present method, there is no fluctuation in the cross-sectional void area ratio due to deformation at the time of cutting.

The measurement magnification of the SEM was a suitable magnification for observing the entire cross-section of the multifilament. For the present Examples and Comparative Examples, the measurements were performed at a magnification in the range of 100 to 250 times.

Regarding the number of measurements taken, 5 sampling points were taken at intervals of not less than 1 m apart of the same yarn package, and the average value of the 2 sampling points with the largest cross-sectional void area ratio calculated from the cross-section was taken as the cross-sectional void area ratio of the sample.

For a multifilament in a fabric, the fabric and processed threads can be disassembled, the multifilament can be removed, 5 sampling points can be taken, and the cross-sectional void area ratio can be measured using the same method as described above.

The cross-sectional void area ratio was calculated using the area measurement function of the software "SEM Control User Interface ver. 3.02" made by JEOL Ltd. More specifically, using the "polygon" feature of the area measurement function, by continuously tracing the outer perimeter of all of the individual filaments of the multifilament cross-section in the SEM photograph to be measured, the area (A) of the cross-section of the multifilament was found, and then, by using the "polygon" feature of the area measurement function in a similar manner, the area (B) of the void part of the multifilament was calculated by tracing the inner side of each individual filament in the void area demarcated by the mutual contacting of individual filaments. Using the values (A+B) and (B) measured in this manner, the cross-sectional void area ratio (%) was calculated according to the above formula.

"Mutual contacting of individual filaments" even includes cases in which individual filaments are not completely contacting each other; in the case when the center-to-center distance (L) between individual filaments is not more than the average filament diameter (d)×2, the individual filaments which are not completely contacting each other are referred to as "mutually contacting". In such cases, "trace" means to trace a straight line formed between the centers of 2 adjacent individual filaments.

The relationship between L and d shall be according to the handling method described hereinafter for the case when there is a void part which is not completely demarcated (not surrounded) by individual filaments.

FIG. 1 shows a schematic diagram of the multifilament cross-section for explaining how to find the area of the cross-sectional part and the area of the void part.

When the individual filaments constituting the external perimeter of the cross-section were discontinuous (i.e., in the state of "individual filaments not mutually contacting" above) and there was a void part that was not demarcated (not surrounded) by individual filaments, the center-to-center distance L and the average individual filament diameter d of 2 individual filaments which were the closest in the discontinuous part and were not contacting were used to judge whether those filaments could be included in the external perimeter as "mutually contacting". The average filament diameter d was found by using the SEM photographs of 5 multifilaments, which were the same as the multifilament used for calculating the cross-sectional void area ratio, measuring the number of all individual filaments constituting each multifilament and the cross-sectional diameter for each filament, and averaging (dividing by 5) the values found for each multifilament. In cases where the individual filament was not a perfect circle, other than dividing the sum of the major axis and the minor axis by 2 and using the result as the individual filament diameter, the average individual filament average d was found by the same method as described above. The center of the individual filament was taken to be the point of intersection of straight lines used to calculate the major axis and minor axis.

<When L>2d>

Figure 2:
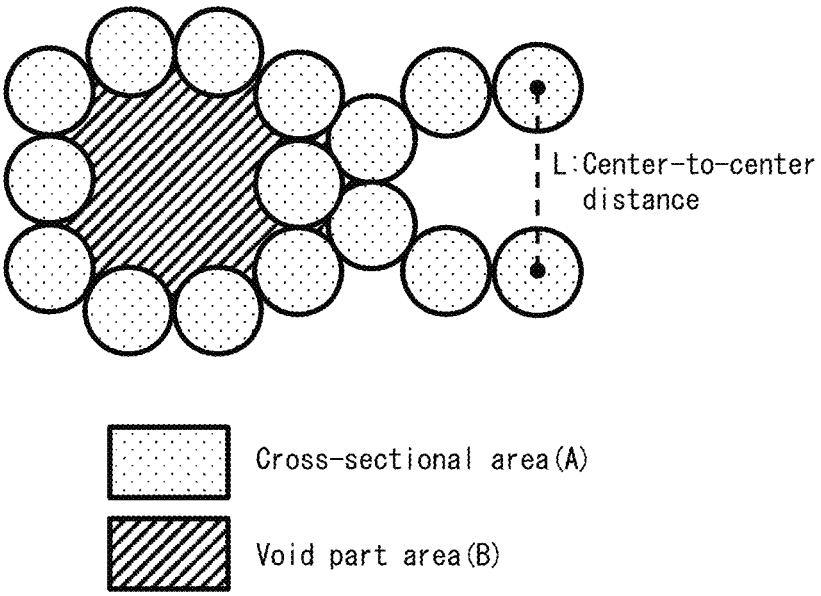
FIG. 2 is a schematic diagram showing the multifilament cross-section for explaining the part considered to be the void part when L>2d.

Two individual filaments on the end which were not mutually contacting were judged to be discontinuous, and the area of the void part which was not completely surrounded by individual filaments was not included in the void area. FIG. 2 shows an example of a void part not completely surrounded by individual filaments.

<When L2d>

Figure 3:
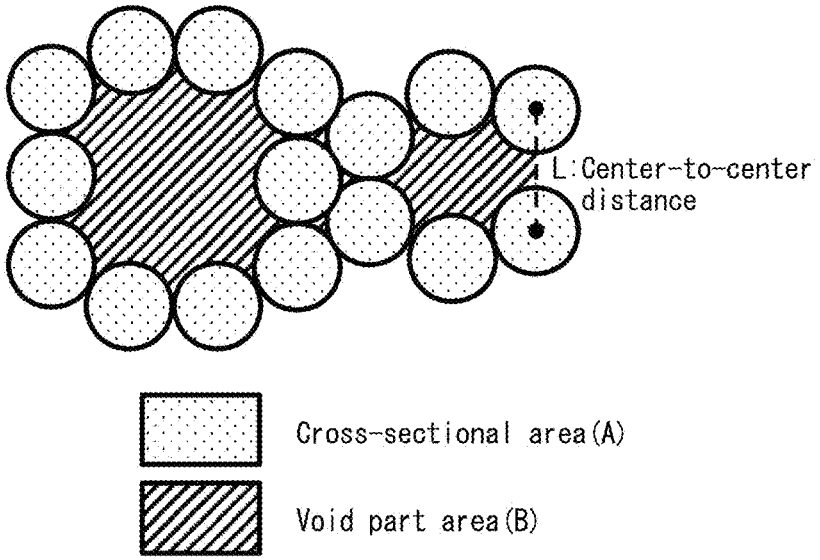
FIG. 3 is a schematic diagram showing the multifilament cross-section for explaining the part considered to be the void part when L≤2d.

Two individual filaments on the end which were not mutually contacting were judged to be continuous, and a straight line joining the centers of the two individual filaments was taken to be a line (perimeter) that supplements the discontinuous part, and the void part surrounded by that line was included in the void area. FIG. 3 schematically shows the multifilament cross-section as an example, and in this case, the void part was included in the void area.

(2) Number of Void Parts Larger than the Size of an Individual Filament with the Same Diameter as the Average Individual Filament Diameter The number of void parts the same size or larger than an individual filament having a diameter of a perfect circle of the average individual filament diameter calculated using the SEM photographs of 2 samples with the largest cross-sectional void area ratio among the 5 samples measured in (1) was determined. The average individual filament diameter d was found in the same manner as (1), and regarding the two SEM photographs above, "void parts larger than the size of an individual filament with the same diameter as the average individual filament diameter" means a void part in which, supposing an individual filament having a perfect circle of the average individual filament diameter d, the theoretical individual filament could be placed in the void part without contacting any mutually contacting individual filaments, other than the theoretical filament, which demarcate the void part when placing the theoretical filament within the void part. Regarding the two SEM photographs above, if one of such void parts existed in either of the two SEM photographs, the number of void parts larger than the size of an individual filament with the same diameter as the average individual filament diameter, and if one or more such void parts existed in both collectively, the number of the largest void parts was adopted as the number of void parts larger than the size of an individual filament with the same diameter as the average individual filament diameter.

(3) Measurement of Fineness

One multifilament was unwound from a yarn package such that no tensile force was exerted, and 1 m, measured in a state with no tension and no slack, was cut off, the weight thereof was measured, and the fineness thereof was found according the following formula:

$$\text{fineness (dt)} = 10{,}000 \times \text{weight (g) per meter}$$

The measurement was performed 5 times, and the average value was taken to be the fineness.

Figure 4:
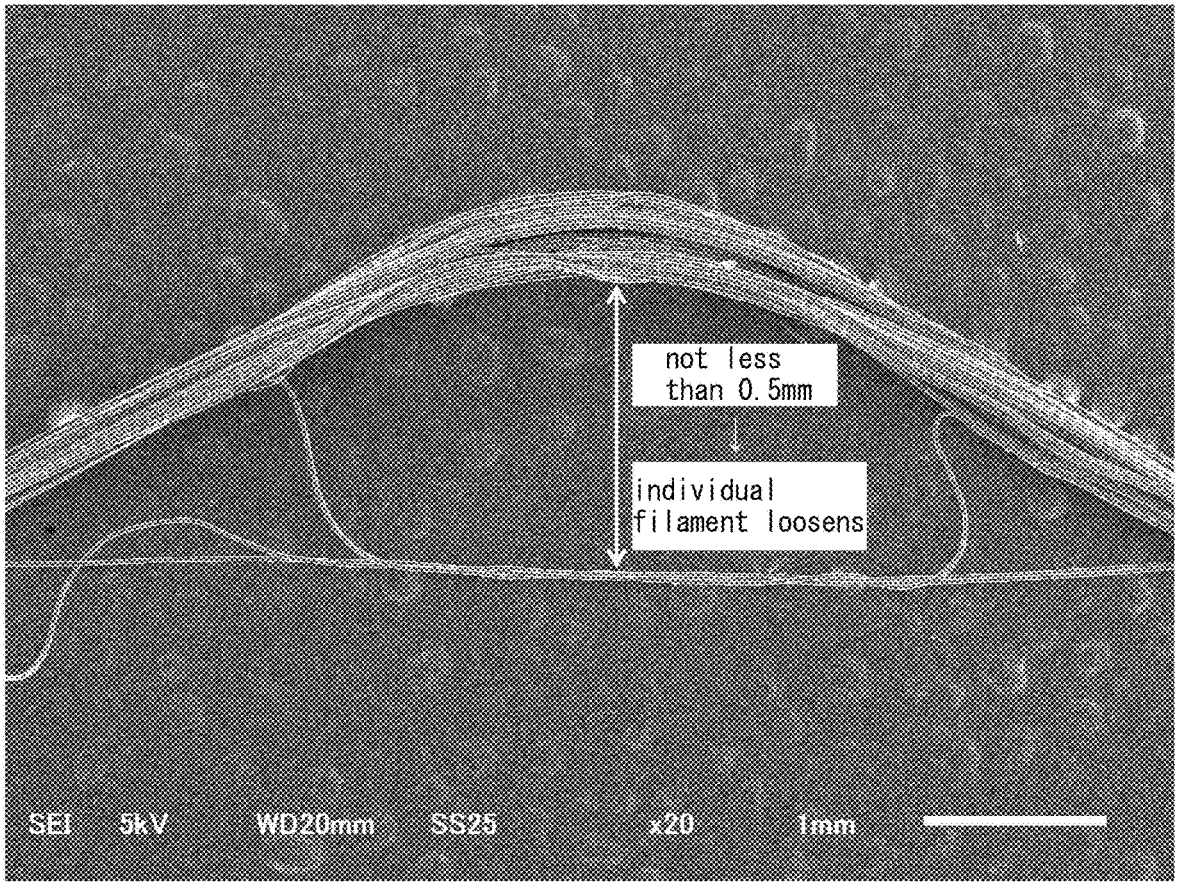
FIG. 4 is a photograph showing an individual filament in a loose state.

(4) Measurement of Individual Filament Looseness Occurrence Rate 10 multifilaments with a length of 40 mm were set so as to be parallel in a De Mattie tester. An operation of stretching the multifilaments in the longitudinal direction until reaching a length of 240 mm and allowing them to return to 40 mm was repeated 5000 times at a speed of 200 rpm. Then, each 40 mm-long multifilament was laid flat as shown in FIG. 4, and cases in which a filament was located a maximum distance of not less than 0.5 mm from the part of the multifilament where the individual fibers were the most bundled and cases in which a filament was broken were considered to be an occurrence of individual filament looseness. The measurement of a set of 10 multifilaments of the same sample was performed 5 times, and how many threads of the total 50 had some looseness were counted and the occurrence rate was calculated.

(5) Quantitative Measurement Method of Magnesium Stearate Contained in the Thread About 1 g of test sample was measured out into a 50 ml Erlenmeyer flask, and soaked in 8 ml of 5 to 10% methanol hydrogen chloride (Tokyo Chemical Industry Co., Ltd.). This was heated at 120° C. for 1 hour under reflux, and treatment of derivatization to a methyl ester was performed. After the reaction solution was collected, it was brought to a constant volume of 20 ml with methanol, and measured and quantified by GC/MS.

(6) Running Stress Measurement Method

Figure 5:
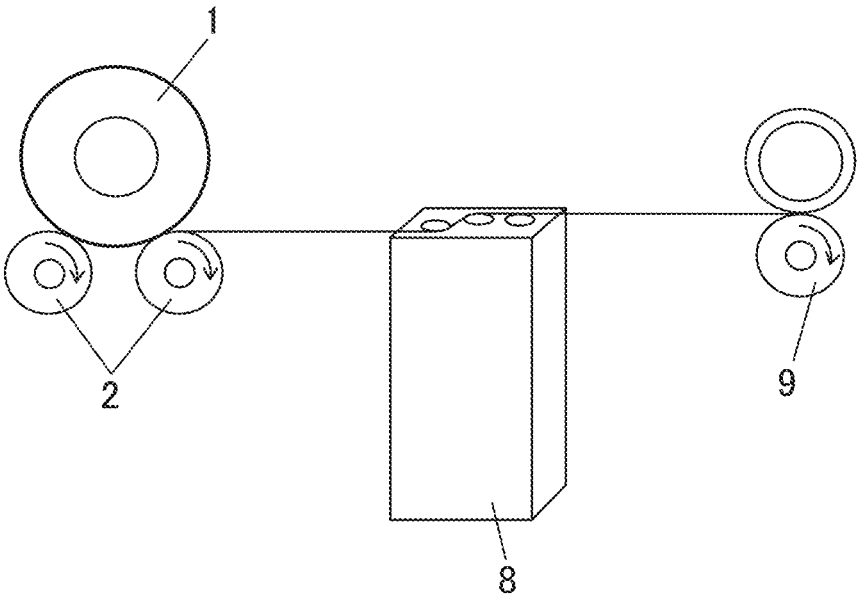
FIG. 5 is a schematic diagram of a device used in running stress measurements.

A yarn package 1 of the elastic fiber obtained by spinning was placed in a device as shown in FIG. 5, an elastic fiber feeder roller 2 was run at a speed of 10 m/minute, and a take-up roller 9 was run at a speed of 30 m/minute (i.e., 3 times stretch ratio), and the stress (g) at the time of thread running was measured in 3-minute intervals by tension meter 8. The value from dividing the average value of the obtained stress values by the fineness of the elastic fiber was taken as the running stress (g/dt). If this value is too high, the cross-sectional void area ratio fluctuates more readily over time, and if the value is too low, the stretchiness is low and filaments loosen more readily.

(7) Evaluation of Bleeding of Surface Treating Agent During Storage

One yarn package of polyurethane elastic fiber wound around a paper tube with a diameter of 8.2 cm and a width of 11.5 cm to form a winding width of 9 cm and a winding diameter of 18 cm was placed in the center of a cardboard box of length 32 cm×width 23 cm×height 24.5 cm and thickness: 0.5 cm, a lid was placed to close the box, which was stored for 4 weeks in hot air storage at 50° C. After 4 weeks, the status of bleeding of surface treating agent into the interior of the cardboard box, and the status of bleeding of surface treating agent onto the paper tube after the thread had been removed were evaluated visually.

(8) Measurement of the Dynamic Friction Coefficient (μd) after Aging

Using the thread of the same winding diameter as the yarn package used in the evaluation of (7), using the 2 yarn packages, one from before the 4-week storage in the 50° C. hot air storage (i.e. before aging) and one from after 4-week storage in the 50° C. hot air storage (i.e. after aging), each was removed up to 1 cm from the paper tube, μd was measured according to the following procedure, and the difference (Δμd) of μd from before and after 50° C. storage was found.

Specifically, the dynamic friction coefficient (μd) was found using the ratio of thread tensions of the thread before and after running through a ceramic guide. Essentially, the thread tension ($T_1$) on the input side, and the thread tension ($T_2$) of the output side were measured when inserting a ceramic guide (Yuasa Yarn: A204062 Hook Guide) into the running path of the thread at a friction angle of 90° when the feed rate from the package was 50 m/minute and a take-up rate is 150 m/minute. The dynamic friction coefficient (μd) was calculated according to the following formula:

$$\text{dynamic friction coefficient } (\mu d) = \ln(T_2/T_1)/0.5\pi$$

In order to achieve a friction angle of 90°, any type of low-friction guide or rotation roller can be used in the thread path. The smaller the value of μd, the lower friction with the ceramic guide, which is good, and the smaller the difference in μd values before and after aging, the smaller the fluctuations in friction for storage in a warehouse, such that the stability as a product is high. More specifically, from the perspective of friction characteristics and stability as a product, AO is preferably not more than 0.1, or more preferably not more than 0.06.

(9) Inner Layer Filament Swing after Aging

Figure 6:
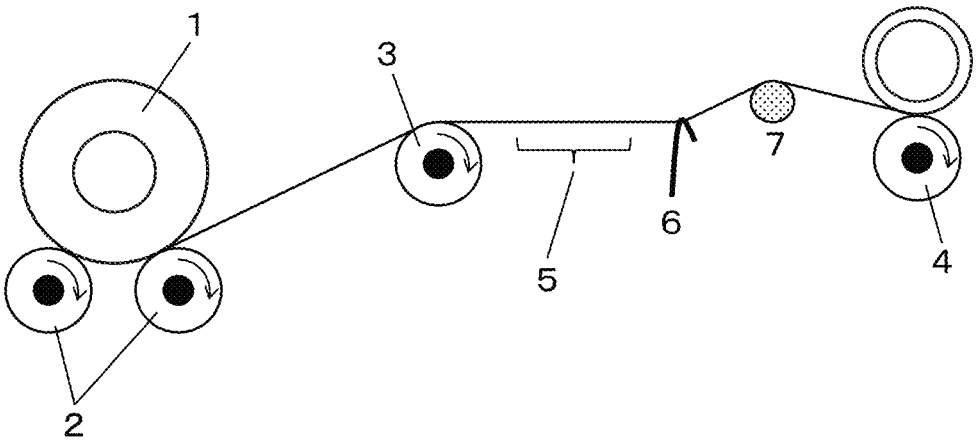
FIG. 6 is a schematic diagram of a device used for inner layer filament swing evaluation after aging.
Figure 7:
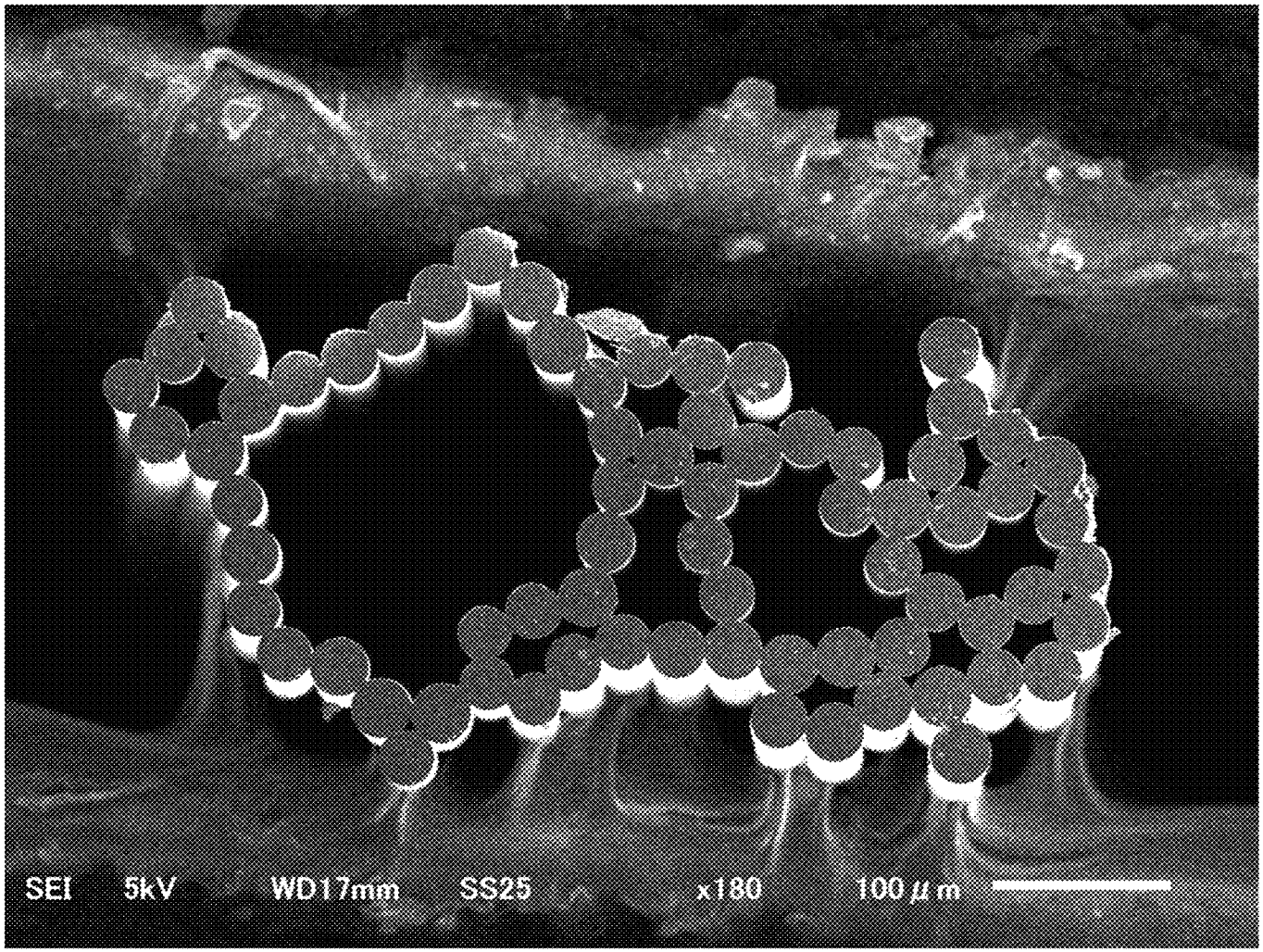
FIG. 7 is a cross-sectional SEM image that is representative of the polyurethane elastic fiber of the present invention.

The polyurethane elastic fiber aged in (7) above was removed from the paper tube until at a winding thickness of 1 cm, and placed in the device shown in FIG. 6, which was run with the elastic fiber feeding roller 2 set at a rate of 50 m/minute, the pre-draft roller 3 with elastic fiber wrapped 3 times therearound set to a rate of 80 m/minute, and the take-up roller 4 set at a rate of 85 m/minute. The behavior of the elastic fiber of the observed portion 5 was observed for 3 minutes, and filament swing was evaluated according to the following evaluation criteria. Regarding the current evaluation, the smaller the filament swing width, the smaller the friction resistance at the time of use of the thread, and thread breakage occurs less readily.

Excellent: filament swing width was not less than 0 mm and less than 2 mm

Good: filament swing width was not less than 2 mm and less than 4 mm

Fair: filament swing width was not less than 4 mm and less than 6 mm

Poor: filament swing width was not less than 6 mm or thread broke

If the filament swing width went back and forth between 2 values of the above evaluation criteria during the 3 minutes of visual observation, a range of results, for example, "Fair to Good" were used.

(10) Cross-Sectional Void Area Ratio of Yarn Package after Aging

Other than measuring the polyurethane elastic fiber after aging in (7) above, the measurement was performed using the same method as in (1) above.

(11) Measurement of Cross-Sectional Void Area Ratio of Polyurethane Elastic Fiber Included in Gathered Member A hot melt adhesive (Henkel Japan Ltd., 765E) melted at 150° C., 5 polyurethane elastic fibers were aligned in parallel at 7 mm intervals, stretched to a length 3 times the original length, and while hot melt adhesive (Henkel Japan Ltd. 765E) melted at 150° C. was continuously applied using a V-slit such that the adhered amount was 0.04 g/m per polyurethane elastic fiber, the polyurethane elastic fiber on which the hot melt adhesive was applied was continuously pinched by 2 pieces of non-woven cloth (Asahi Kasei Corp., Eltas Guard™) with basis weights of 17 g/m$^2$ and widths of 30 cm, and at a pair of rollers from above with outer diameters of 16 cm and widths of 40 cm, one roller pushed at the air cylinder (SMC, CQ2WB100-50DZ), which supplied an air pressure of 0.5 MPa, and continuously crimped to produce a gathered member. The produced gather was immediately cut, and left to sit at 20° C. and 65% relative humidity for 24 hours, and then soaked in cyclohexane for 10 minutes, the hot melt adhesive was dissolved and removed, and the polyurethane elastic fiber from the gathered member was removed, and set slack on top of filter paper, and dried at 20° C. and 65% relative humidity for 12 hours. At an interval of not less than 1 m away on the same yarn package, the cross-sectional void area ratio was measured in the same manner as in (1) other than using the polyurethane elastic fiber taken as described above instead of 5 strand sampling.

In the case of a gathered member produced by a method in which no hot melt adhesive is used, such as a method in which thermocompression rollers, ultrasonic bonding, or the like are used, whereby removing a polyurethane elastic fiber from the gathered member is difficult, the gathered member comprising the polyurethane elastic fiber can be cut into 10 cm portions, left to sit in a slack condition at 20° C. and 65% relative humidity for 12 hours, and then the cross-sections of the gathered member comprising the polyurethane elastic fiber can be observed via SEM, and the cross-sectional void area ratio can be calculated in the same manner as in (1).

(12) Method for Evaluating Adhesiveness (Evaluating Slip-Back Occurrence Rate)

The gathered member produced in (11) was taken as a sample, and the sample was cut to a length of 250 mm to 300 mm in the thread direction (the length of the gathered member at this time was taken as the initial length), and with the sample stretched to a length in the thread direction 3 times the initial length, the sample was pasted to a piece of cardboard. Next, marks were made through a non-woven cloth using an oil-based pen at 2 freely-chosen points such that the length of the pasted polyurethane elastic fiber was 200 mm. Thus, the ink bled through the non-woven cloth and left a mark of ink on the polyurethane elastic fiber. The polyurethane elastic fiber and the non-woven cloth attached were cut at the location of this mark, and then left to sit at 40° C. for 5 hours. At the end of the 5 hours, the length between the 2 points with the marks on the polyurethane elastic fiber were measured and the retention rate was calculated according to the following formula:

Adhesive retention rate=100×(measured length mm after 5 hours)/200 mm

The higher the retention rate, the less frequent the slip-back of polyurethane elastic fiber during production or when wearing. The measurement was performed 10 times per sample, and the slip-back occurrence rate was found using the average value and the following evaluation criteria:

5: Average value of 10 measurements of adhesive retention rate was not less than 95%

4: Average value of 10 measurements of adhesive retention rate was not less than 90% and less than 95%

3: Average value of 10 measurements of adhesive retention rate was not less than 85% and less than 90%

2: Average value of 10 measurements of adhesive retention rate was not less than 80% and less than 85%

1: Average value of 10 measurements of adhesive retention rate was less than 80%

Example 1

2000 g of polytetramethylene ether glycol with a number average molecular weight of 2,000 were mixed and reacted with 400 g of 4,4'-diphenylmethane diisocyanate in a dry nitrogen atmosphere at 60° C. for 3 hours to obtain a polyurethane prepolymer with the end capped by isocyanate. After the prepolymer was cooled to room temperature, dimethylacetamide was added, the prepolymer was dissolved to make a polyurethane prepolymer solution.

Additionally, a solution in which 33.8 g of ethylene diamine and 5.4 g of diethyl amine was dissolved in dry dimethylacetamide was prepared and added to the prepolymer solution above at room temperature to obtain a polyurethane solution with a polyurethane solid portion concentration of 30 mass %, and a viscosity of 450 Pa·s (30° C.).

Cyanox1790 (TM, Cytec Industries Inc.) as a hindered phenolic antioxidant, and Tinuvin234 (TM, BASF Corp.) as a UV absorber were each prepared in a 10 mass % dimethyl acetamide solution, and added to and mixed with polyurethane polymer so as to make the solid portion of the antioxidant 1.00 mass % relative to the polyurethane polymer, and so as to make the UV absorber 0.25 mass % relative to the polyurethane polymer to obtain a homogenous solution. Thereafter, the solution was defoamed at room temperature under reduced pressure and made a spinning dope.

The spinning dope was dry spun using a spinneret consisting of an annular array of 14 holes with a hole-to-hole pitch of 20 mm within the same circle, at a hot air temperature of 310° C., and at a take-up rate of 500 m/minute such that the ratio of the first godet roller and the final take-up rate (=final take-up rate/first godet roller rate) was 1.15. After the multifilament was bundled by an air false-twist texturing device using compressed air at 0.20 MPa, 3.0 mass % of a surface treating agent was applied to the polyurethane elastic fibers. The fiber was wound on a paper tube to obtain a wound package of polyurethane elastic fiber with 150 dt/14 filaments. Further, the surface treating agent was an oil consisting of 67 mass % polydimethylsiloxane, 30 mass % mineral oil, and 3.0 mass % amino-modified silicone.

Example 2

Other than using a spinneret consisting of an annular array of 28 holes with a hole-to-hole pitch of 20 mm within the same circle, setting the ratio of the final take-up rate to the first godet roller rate to 1.10, and adjusting the discharge amount of the spinning dope such that a fineness of 310 dt was achieved, a polyurethane elastic fiber with 310 dt/28 filaments was obtained in a similar manner as Example 1.

Example 3

Other than using a spinneret consisting of an annular array of 36 holes with a hole-to-hole pitch of 15 mm within the same circle, setting the ratio of the final take-up rate to the first godet roller rate to 1.20, and adjusting the discharge amount of the spinning dope such that a fineness of 310 dt was achieved, a polyurethane elastic fiber with 310 dt/36 filaments was obtained in a similar manner as Example 1.

Example 4

Other than using a spinneret consisting of an annular array of 36 holes with a hole-to-hole pitch of 20 mm within the same circle, setting the ratio of the final take-up rate to the first godet roller rate to 1.10, and adjusting the discharge amount of the spinning dope such that a fineness of 310 dt was achieved, a polyurethane elastic fiber with 310 dt/36 filaments was obtained in a similar manner as Example 1.

Example 5

Other than using a spinneret consisting of an annular array of 36 holes with a hole-to-hole pitch of 20 mm within the same circle, setting the ratio of the final take-up rate to the first godet roller rate to 1.08, using an air false-twist texturing device at a compressed air pressure of 0.15 MPa, and adjusting the discharge amount of the spinning dope such that a fineness of 310 dt was achieved, a polyurethane elastic fiber with 310 dt/36 filaments was obtained in a similar manner as Example 1.

Example 6

Other than using a spinneret consisting of an annular array of 36 holes with a hole-to-hole pitch of 15 mm within the same circle, setting the ratio of the final take-up rate to the first godet roller rate to 1.15, and adjusting the discharge amount of the spinning dope such that a fineness of 310 dt was achieved, a polyurethane elastic fiber with 310 dt/36 filaments was obtained in a similar manner as Example 1.

Example 7

Other than using a spinneret consisting of an annular array of 72 holes with a hole-to-hole pitch of 20 mm within the same circle, setting the ratio of the final take-up rate to the first godet roller rate to 1.08, and adjusting the discharge amount of the spinning dope such that a fineness of 620 dt was achieved, a polyurethane elastic fiber with 620 dt/72 filaments was obtained in a similar manner as Example 1.

Example 8

Other than using a spinneret consisting of an annular array of 72 holes with a hole-to-hole pitch of 25 mm within the same circle, setting the ratio of the final take-up rate to the first godet roller rate to 1.08, using an air false-twist texturing device at a compressed air pressure of 0.15 MPa, and adjusting the discharge amount of the spinning dope such that a fineness of 620 dt was achieved, a polyurethane elastic fiber with 620 dt/72 filaments was obtained in a similar manner as Example 1.

Example 9

Other than including magnesium stearate in the spinning dope such that the amount of magnesium stearate was 0.07 mass % relative to the mass of polyurethane elastic fiber, using a spinneret consisting of an annular array of 72 holes with a hole-to-hole pitch of 20 mm within the same circle, setting the ratio of the final take-up rate to the first godet roller rate to 1.08, and adjusting the discharge amount of the spinning dope such that a fineness of 620 dt was achieved, a polyurethane elastic fiber with 620 dt/72 filaments was obtained in a similar manner as Example 1.

Example 10

Other than including magnesium stearate in the spinning dope such that the amount of magnesium stearate was 0.30 mass % relative to the mass of polyurethane elastic fiber, using a spinneret consisting of an annular array of 72 holes with a hole-to-hole pitch of 20 mm within the same circle, setting the ratio of the final take-up rate to the first godet roller rate to 1.08, and adjusting the discharge amount of the spinning dope such that a fineness of 620 dt was achieved, a polyurethane elastic fiber with 620 dt/72 filaments was obtained in a similar manner as Example 1.

Example 11

Other than using a spinneret consisting of an annular array of 72 holes with a hole-to-hole pitch of 20 mm within the same circle, setting the ratio of the final take-up rate to the first godet roller rate to 1.20, and adjusting the discharge amount of the spinning dope such that a fineness of 620 dt was achieved, a polyurethane elastic fiber with 620 dt/72 filaments was obtained in a similar manner as Example 1.

Example 12

Other than using a spinneret consisting of an annular array of 72 holes with a hole-to-hole pitch of 20 mm within the same circle, setting the ratio of the final take-up rate to the first godet roller rate to 1.02, and adjusting the discharge amount of the spinning dope such that a fineness of 620 dt was achieved, a polyurethane elastic fiber with 620 dt/72 filaments was obtained in a similar manner as Example 1.

Example 13

Other than using a spinneret consisting of an annular array of 72 holes with a hole-to-hole pitch of 20 mm within the same circle, setting the ratio of the final take-up rate to the first godet roller rate to 1.08, and adjusting the discharge amount of the spinning dope such that a fineness of 860 dt was achieved, a polyurethane elastic fiber with 860 dt/72 filaments was obtained in a similar manner as Example 1.

Example 14

Other than using a spinneret consisting of an annular array of 72 holes with a hole-to-hole pitch of 20 mm within the same circle, setting the ratio of the final take-up rate to the first godet roller rate to 1.15, and adjusting the discharge amount of the spinning dope such that a fineness of 940 dt was achieved, a polyurethane elastic fiber with 940 dt/72 filaments was obtained in a similar manner as Example 1.

Example 15

Other than using a spinneret consisting of an annular array of 96 holes with a hole-to-hole pitch of 15 mm within the same circle, setting the ratio of the final take-up rate to the first godet roller rate to 1.15, using an air false-twist texturing device at a compressed air pressure of 0.15 MPa, and adjusting the discharge amount of the spinning dope such that a fineness of 1280 dt was achieved, a polyurethane elastic fiber with 1280 dt/72 filaments was obtained in a similar manner as Example 1.

Comparative Example 1

Other than using a spinneret consisting of an annular array of 36 holes with a hole-to-hole pitch of 10 mm within the same circle, setting the ratio of the final take-up rate to the first godet roller rate to 1.20, using an air false-twist texturing device at a compressed air pressure of 0.27 MPa, and adjusting the discharge amount of the spinning dope such that a fineness of 310 dt was achieved, a polyurethane elastic fiber with 310 dt/36 filaments was obtained in a similar manner as Example 1.

Comparative Example 2

Other than using a spinneret consisting of an annular array of 36 holes with a hole-to-hole pitch of 10 mm within the same circle, setting the ratio of the final take-up rate to the first godet roller rate to 1.30, using an air false-twist texturing device at a compressed air pressure of 0.27 MPa, and adjusting the discharge amount of the spinning dope such that a fineness of 310 dt was achieved, a polyurethane elastic fiber with 310 dt/36 filaments was obtained in a similar manner as Example 1.

Comparative Example 3

Other than using a spinneret consisting of an annular array of 72 holes with a hole-to-hole pitch of 10 mm within the same circle, setting the ratio of the final take-up rate to the first godet roller rate to 1.20, using an air false-twist texturing device at a compressed air pressure of 0.27 MPa, and adjusting the discharge amount of the spinning dope such that a fineness of 620 dt was achieved, a polyurethane elastic fiber with 620 dt/72 filaments was obtained in a similar manner as Example 1.

Comparative Example 4

Other than using a spinneret consisting of an annular array of 28 holes with a hole-to-hole pitch of 20 mm within the same circle, setting the ratio of the final take-up rate to the first godet roller rate to 1.10, compressing the multifilament with a compression roller at a contact pressure 10 N followed by winding the multifilament with a winder, and adjusting the discharge amount of the spinning dope such that a fineness of 310 dt was achieved, a polyurethane elastic fiber with 310 dt/28 filaments was obtained in a similar manner as Example 1.

The manufacturing conditions for each of the Examples and Comparative Examples above, as well as the measurement results for each property of the obtained polyurethane elastic fiber, are shown in Tables 1 and 2 below.

TABLE 1

| | Spinning hole pitch (mm) | Compressed air pressure of air false-twist texturing device (MPa) | Take-up/ godet roller speed ratio | dt | f | Cross-sectional void area ratio (%) | Number of voids large enough to fit circular individual filament of average diameter | StMg Content (wt %) | Running stress (g/dt) | Individual filament looseness occurrence rate (%) |
|---|---|---|---|---|---|---|---|---|---|---|
| Example 1 | 20 | 0.20 | 1.15 | 150 | 14 | 16 | 1 | 0 | 0.127 | 6 |
| Example 2 | 20 | 0.20 | 1.10 | 310 | 28 | 22 | 2 | 0 | 0.114 | 6 |
| Example 3 | 15 | 0.20 | 1.20 | 310 | 36 | 17 | 0 | 0 | 0.125 | 6 |
| Example 4 | 20 | 0.20 | 1.10 | 310 | 36 | 24 | 2 | 0 | 0.115 | 12 |
| Example 5 | 20 | 0.15 | 1.08 | 310 | 36 | 32 | 3 | 0 | 0.111 | 12 |
| Example 6 | 15 | 0.20 | 1.15 | 310 | 36 | 19 | 1 | 0 | 0.119 | 12 |
| Example 7 | 20 | 0.20 | 1.08 | 620 | 72 | 47 | 2 | 0 | 0.101 | 12 |
| Example 8 | 25 | 0.15 | 1.08 | 620 | 72 | 57 | 3 | 0 | 0.1 | 20 |
| Example 9 | 20 | 0.20 | 1.08 | 620 | 72 | 46 | 2 | 0.07 | 0.101 | 18 |
| Example 10 | 20 | 0.20 | 1.08 | 620 | 72 | 45 | 2 | 0.3 | 0.1 | 32 |
| Example 11 | 20 | 0.20 | 1.20 | 620 | 72 | 37 | 1 | 0 | 0.136 | 16 |
| Example 12 | 20 | 0.20 | 1.02 | 620 | 72 | 49 | 2 | 0 | 0.068 | 28 |
| Example 13 | 20 | 0.20 | 1.08 | 860 | 72 | 45 | 2 | 0 | 0.097 | 12 |
| Example 14 | 20 | 0.20 | 1.15 | 940 | 72 | 24 | 2 | 0 | 0.087 | 28 |
| Example 15 | 15 | 0.15 | 1.15 | 1280 | 96 | 31 | 2 | 0 | 0.079 | 34 |
| Comparative Example 1 | 10 | 0.27 | 1.20 | 310 | 36 | 13 | 0 | 0 | 0.133 | 10 |
| Comparative Example 2 | 10 | 0.27 | 1.30 | 310 | 36 | 11 | 0 | 0 | 0.137 | 8 |
| Comparative Example 3 | 10 | 0.27 | 1.20 | 620 | 72 | 7 | 0 | 0 | 0.131 | 12 |
| Comparative Example 4 | 20 | 0.20 | 1.10 | 310 | 28 | 9 | 0 | 0 | 0.112 | 6 |

TABLE 2

| | Cross-sectional void area ratio after aging (%) | Cross-sectional void area ratio of polyurethane elastic fiber contained in a gathered member (%) | Evaluation of core slip-back occurrence rate | Evaluation of surface treatment agent and exudation | | Evaluation after aging | | | |
|---|---|---|---|---|---|---|---|---|---|
| | | | | Box | Paper tube | Inner layer before aging μd | Inner layer after aging μd | Δμd (After aging − before aging) | Inner layer filament swing after again |
| Example 1 | 15 | 15 | 3 | No | No | 0.36 | 0.40 | 0.04 | Good |
| Example 2 | 22 | 21 | 5 | No | No | 0.38 | 0.41 | 0.03 | Excellent |
| Example 3 | 16 | 16 | 3 | No | No | 0.39 | 0.46 | 0.07 | Fair to Good |
| Example 4 | 24 | 22 | 5 | No | No | 0.39 | 0.41 | 0.02 | Excellent |
| Example 5 | 31 | 32 | 5 | No | No | 0.40 | 0.42 | 0.02 | Excellent |
| Example 6 | 17 | 18 | 4 | No | No | 0.40 | 0.44 | 0.04 | Good to Excellent |
| Example 7 | 45 | 40 | 5 | No | No | 0.50 | 0.52 | 0.02 | Excellent |
| Example 8 | 55 | 53 | 3 | No | No | 0.47 | 0.48 | 0.01 | Excellent |
| Example 9 | 42 | 41 | 4 | No | No | 0.49 | 0.51 | 0.02 | Excellent |
| Example 10 | 41 | 39 | 2 | No | No | 0.47 | 0.49 | 0.02 | Excellent |
| Example 11 | 17 | 19 | 2 | No | No | 0.49 | 0.60 | 0.11 | Fair to Good |
| Example 12 | 44 | 42 | 2 | No | No | 0.45 | 0.55 | 0.10 | Fair to Good |

TABLE 2-continued

| | Cross-sectional void area ratio after aging (%) | Cross-sectional void area ratio of polyurethane elastic fiber contained in a gathered member (%) | Evaluation of core slip-back occurrence rate | Evaluation of surface treatment agent and exudation | | Evaluation after aging | | | |
|---|---|---|---|---|---|---|---|---|---|
| | | | | Box | Paper tube | Inner layer before aging μd | Inner layer after aging μd | Δμd (After aging − before aging) | Inner layer filament swing after again |
| Example 13 | 41 | 40 | 5 | No | No | 0.52 | 0.55 | 0.03 | Excellent |
| Example 14 | 24 | 24 | 2 | No | No | 0.56 | 0.59 | 0.03 | Excellent |
| Example 15 | 29 | 29 | 2 | No | No | 0.61 | 0.69 | 0.08 | Good |
| Comparative Example 1 | 8 | 11 | 1 | Yes | Yes | 0.37 | 0.48 | 0.11 | Fair |
| Comparative Example 2 | 6 | 9 | 1 | Yes | Yes | 0.40 | 0.53 | 0.13 | Fair |
| Comparative Example 3 | 6 | 6 | 1 | Yes | Yes | 0.52 | 0.66 | 0.14 | Poor |
| Comparative Example 4 | 9 | 8 | 1 | Yes | Yes | 0.37 | 0.45 | 0.08 | Poor |

INDUSTRIAL APPLICABILITY

Using the polyurethane elastic fiber of the present invention, even in the case of long-term storage in a warehouse after producing the polyurethane elastic fiber, it is possible to eliminate contaminating the packaging contents, reduce the frequency of thread breaks during use due to the lack of fluctuations in friction characteristics of the product over time, and increase manufacturability. Additionally, since the amount of surface treating agent adhering to the polyurethane elastic fiber even when in a gathered member is stable, a gathered member with few adhesion spots and a low occurrence of core slip-back of the polyurethane elastic fiber due to bleeding can be provided. The gathered member of the present invention has a low occurrence of core slip-back.

REFERENCE SIGNS LIST

1 yarn package of elastic fibers
2 feeding roller
3 pre-draft roller
4 take-up roller
5 observed portion
6 ceramic hook guide
7 bearing-free roller
8 tension meter
9 take-up roller

The invention claimed is:

1. A polyurethane elastic fiber comprising a multifilament, characterized by having, in a multifilament cross-section, a void part demarcated by the constituent individual filaments being in contact with one another, and by having a cross-sectional void area ratio of 15% to 60% as calculated according to the formula:

cross-sectional void area ratio (%)=(area of the void part/total cross-sectional area)×100, wherein:

the total cross-sectional area is the sum of the area of the void part and the cross-sectional areas of all the individual filaments which constitute the multifilament, and an individual filament looseness occurrence rate is not more than 20% when an operation of extending a 40 mm-long multifilament to a length of 240 mm and then returning the multifilament to 40 mm again with a De Mattie tester is repeated 5000 times at a speed of 200 rpm.

2. The polyurethane elastic fiber of claim 1, wherein the fineness of the multifilament is not less than 150 dt and not more than 1300 dt.

3. The polyurethane elastic fiber of claim 1, wherein the fineness of the multifilament is not less than 150 dt and not more than 900 dt.

4. The polyurethane elastic fiber of claim 1, wherein the number of individual filaments constituting the multifilament is not less than 14 and not more than 140.

5. The polyurethane elastic fiber of claim 1, wherein in the multifilament cross-section, there exists at least one void part bigger than an individual filament having a diameter equal to the average individual filament diameter calculated using all of the individual filaments constituting the multifilament.

6. The polyurethane elastic fiber of claim 1, wherein the individual filament looseness occurrence rate is not more than 13%.

7. The polyurethane elastic fiber of claim 1, wherein the content of long-chain aliphatic metal salts having 10 to 20 carbon atoms is 0 to 0.2 mass % relative to the weight of polyurethane elastic fiber.

8. A yarn package comprising the polyurethane elastic fiber of claim 1.

9. The yarn package of claim 8, wherein the running stress in draft 3.0 is not less than 0.075 g/dt and not more than 0.130 g/dt.

10. A fabric comprising the polyurethane elastic fiber of claim 1.

11. A gathered member formed by interposing the polyurethane elastic fiber of claim 1 between non-woven cloths.

12. A gathered member comprising a polyurethane elastic fiber characterized by having, in the cross-section of polyurethane elastic fiber comprising a multifilament which is contained in the gathered member, a void part demarcated by the constituent individual filaments being in contact with one another, and by having a cross-sectional void area ratio of 15% to 60% as calculated according to the formula:

cross-sectional void area ratio (%)=(area of the void part/total cross-sectional area)×100, wherein:

the total cross-sectional area is the sum of the area of the void part and the cross-sectional areas of all individual filaments that constitute the multifilament, and an individual filament looseness occurrence rate is not more than 20% when an operation of extending a 40 mm-long multifilament to a length of 240 mm and then returning the multifilament to 40 mm again with a De Mattie tester is repeated 5000 times at a speed of 200 rpm.

* * * * *